US008133126B2

(12) United States Patent
Pouliot et al.

(10) Patent No.: US 8,133,126 B2
(45) Date of Patent: Mar. 13, 2012

(54) GOLF CLUB HAVING ALIGNMENT MARKINGS

(75) Inventors: Jason Pouliot, Corona Del Mar, CA (US); Andre Shmoldas, Solana Beach, CA (US)

(73) Assignee: Premium Golf Brands, LLC, Corona Del Mar, CA (US)

( * ) Notice: Subject to any disclaimer, the term of this patent is extended or adjusted under 35 U.S.C. 154(b) by 57 days.

(21) Appl. No.: 12/464,767

(22) Filed: May 12, 2009

(65) Prior Publication Data

US 2009/0286612 A1 Nov. 19, 2009

Related U.S. Application Data

(60) Provisional application No. 61/053,618, filed on May 15, 2008.

(51) Int. Cl.
*A63B 69/36* (2006.01)

(52) U.S. Cl. ..... 473/238; 473/242; 473/251; 473/254

(58) Field of Classification Search ..... 473/219–256; D21/736–746, 751, 753, 756, 757, 759
See application file for complete search history.

(56) References Cited

U.S. PATENT DOCUMENTS

| | | | | | |
|---|---|---|---|---|---|
| 1,536,512 | A | * | 5/1925 | McLaren | 473/238 |
| 1,712,609 | A | * | 5/1929 | Gibson | 473/233 |
| 2,027,452 | A | * | 1/1936 | Rusing | 473/246 |
| D111,855 | S | * | 10/1938 | Moreno | D21/759 |
| D150,497 | S | * | 8/1948 | Forsell | D21/759 |
| 2,503,506 | A | * | 4/1950 | Miller | 473/251 |
| 2,898,109 | A | * | 8/1959 | Williams | 473/240 |
| D191,211 | S | * | 8/1961 | Forest | D21/741 |
| 3,033,574 | A | * | 5/1962 | Partridge | 473/251 |
| 3,118,678 | A | * | 1/1964 | Rohr | 473/240 |
| 3,198,525 | A | * | 8/1965 | Smith | 473/238 |
| 3,262,705 | A | * | 7/1966 | Nunziato | 473/238 |
| 3,298,693 | A | * | 1/1967 | Eisenberg | 473/238 |
| 4,629,193 | A | * | 12/1986 | Pierman | 473/254 |
| 4,746,124 | A | * | 5/1988 | Comitz | 473/254 |
| 4,919,424 | A | * | 4/1990 | Fukumochi et al. | 473/240 |
| 4,953,867 | A | * | 9/1990 | Rigsby | 473/238 |
| 4,988,107 | A | * | 1/1991 | Sasse | 473/254 |
| 5,143,376 | A | * | 9/1992 | Johnson | 473/228 |
| 5,160,144 | A | * | 11/1992 | Maniatis | 473/251 |
| 5,470,063 | A | * | 11/1995 | Fisher | 473/248 |
| 5,564,990 | A | * | 10/1996 | Weeks | 473/251 |
| 5,605,509 | A | * | 2/1997 | Gray | 473/237 |

(Continued)

*Primary Examiner* — Sebastiano Passaniti
(74) *Attorney, Agent, or Firm* — Mitchell P. Brook; Luce, Forward, Hamilton & Scripps LLP

(57) ABSTRACT

The present invention relates to a golf club having alignment markings that assist a golfer in finding a proper and consistent posture before addressing the ball. In one embodiment, a golf club according to the present invention includes a shaft, a club head having a striking face, a hosel coupling the club head to the shaft, and one or more alignment markings at a position substantially elevated from the club head and substantially behind the shaft. Embodiments of the golf club may further comprise an appendage extending outwardly from the golf club and carrying alignment markings thereon in a direction substantially parallel to the striking face. Such alignment markings provide a golfer with a proper setup when the shaft is seen by the golfer as interposed between, and parallel to, the alignment markings. A golf club according to the present invention may be configured in a variety of shapes, for example, as a putter, an iron, a driver or a wood.

18 Claims, 15 Drawing Sheets

U.S. PATENT DOCUMENTS 5,716,286 A * 2/1998 Swan ..... 473/175
6,200,227 B1 * 3/2001 Sery ..... 473/251
6,663,496 B2 * 12/2003 Cameron et al. ..... 473/220
7,101,288 B2 * 9/2006 Thomas ..... 473/242

* cited by examiner

GOLF CLUB HAVING ALIGNMENT MARKINGS

CROSS-REFERENCE TO RELATED APPLICATION

This application claims priority to U.S. Provisional Patent Application Ser. No. 61/053,618, filed May 15, 2008, which is incorporated herein by reference in its entirety.

FIELD OF THE INVENTION

The present invention relates to a golf club, and more particularly to a golf club having alignment markings that assist a golfer in a proper positioning of the club before a golf swing.

BACKGROUND OF THE INVENTION

A golfer may be unable to achieve a desired game level due to a poor setup position or alignment before swinging the club. With proper setup and alignment, a golfer can create power and control the direction of a swing. A golfer's ability to address the ball properly, that is, to have the club impact the ball with proper position and alignment can distinguish a skilled from relatively unskilled golfer.

In order to assist a golfer in finding a proper setup position and arc stroke, golf clubs have been developed that include visual indicia of a desired contact position between the club head and the ball. Such visual indicia include markings positioned on an upper surface of the club head, for example, one or more lines perpendicular to the striking face of the club head, or one or more grooves or notches also perpendicular to the striking face of the club head. Other golf clubs have been developed that include combinations of lines on the club head and on the shaft, or combinations of lines on the club head and on the golf ball, which must be aligned to achieve a proper club position. Examples of these types of golf clubs are provided in U.S. Pat. No. 1,631,594 to Redman; U.S. Pat. No. 4,128,244 to Duclos; U.S. Pat. No. 5,690,556 to Condon; U.S. Pat. No. 5,704,851 to Lucetti; U.S. Pat. No. 5,755,625 to Jackson; U.S. Pat. No. 6,447,401 to Torkos; U.S. Pat. No. 6,551,195 to Byrne et al.; U.S. Pat. No. 6,722,998 to Miller; U.S. Pat. No. 6,796,911 and U.S. Pat. No. 7,048,639, both to Grace; U.S. Pat. No. 7,066,829 to Lister; and D502,233, D502,234, and D502,236, all to Grace.

U.S. Pat. No. 5,564,990 and D404,450, both to Weeks, illustrate a putter having alignment indicator on the upper surface of the club head that has two lines parallel to the striking face with a center marking disposed therebetween.

Golf clubs having hosels are also known and have become increasingly popular. A hosel operates as a connector between the club head and the shaft and can influence the balance, feel and power of a golf club. Some modern hosels are designed to place as little mass as possible over the top portion of a club head, especially in open top head designs, thereby lowering the center of gravity of the club. Golf clubs having hosels and various types of indicia on the club head have been described in U.S. Pat. No. 5,014,992 to McCallister; U.S. Pat. No. 5,255,919 to Johnson; U.S. Pat. No. 6,409,610 to Ahn et al.; U.S. Pat. No. 6,422,949 to Byrne et al.; and U.S. Pat. No. 6,817,953 to Farmer.

Hosel designs can result in club heads to have upper surfaces that are curved, making it difficult to place alignment indicia thereon that are accurately visualized by a golfer. This disadvantage is can further be found in club designs, in which the hosel joins the club head near the toe end of the club head, reducing the available space for placement of alignment indicia.

It is desired to provide a golf club that includes a hosel and that also includes indicia adapted to assist a golfer in achieving a proper setup and alignment before addressing a ball.

It is also desired to provide a golf club that includes indicia or markings adapted to assist the golfer in finding the proper arc stroke during a golf swing.

In particular, it is desired to provide a golf club that includes a hosel and that also includes indicia adapted to assist a golfer in finding a proper position of the golf club in relation to the ground surface and to the ball to be struck.

SUMMARY OF THE INVENTION

The present invention relates to a golf club having alignment or set-up markings that assist a golfer in finding a desired setup position before addressing the ball, and to achieve the desired setup position with consistency. The alignment or set-up markings are positioned on one or more of a hosel surface, an appendage from the hosel, an appendage from the club head body, or on a surface of the club head. A golf club according to the present invention may be configured in a variety of shapes, for example, as a putter, an iron, or a wood.

In one embodiment, a golf club according to the present invention includes a shaft having a substantially tubular shape, a club head having a striking face on one side, a hosel coupling the club head to the shaft, and one or more alignment markings at a position substantially elevated from the club head and substantially behind the shaft. Embodiments may further comprise an appendage extending outwardly from the golf club and having first and second alignment markings thereon in a direction substantially parallel to the striking face. Such alignment markings assist a golfer in finding a proper setup when the golfer is positioned near the ball to be struck and the shaft can be seen by the golfer as interposed between, and parallel to, the alignment markings.

The appendage may extend outwardly from the shaft, the hosel, or the club head. In a preferred embodiment, the appendage extends rearwardly from the hosel in a direction substantially parallel to the longitudinal axis of the club head.

Still in a preferred embodiment, the hosel includes a lower portion that extends upwardly from the club head, for example, in a direction substantially perpendicular from the club head, and an upper portion configured for coupling the hosel to the shaft, for example, configured as a socket receiving an end of the shaft. The appendage is interposed between the upper and the lower portions of the hosel and extends rearwardly as far as the toe end of the club head, and the club head, the hosel and the appendage are manufactured as a single piece.

The first and the second alignment markings on the appendage may be of different shapes, for example, may be shaped as linear, circular, or elliptical segments, and may have equal or different widths. Further, the first and the second alignment markings may be spaced apart at a distance substantially equal to the diameter of the shaft, so that the shaft will appear to the golfer as disposed between, and parallel to, the markings when a proper position is attained. Alternatively, the first and second markings may be spaced apart less than the diameter of the shaft, so that the markings become hidden by the shaft when a proper position is attained by the golfer.

The first and the second alignment markings may also include a center marking that is interposed between the first and the second markings, so that a proper line of sight is attained by the golfer both when the club is seen as disposed between, and parallel to, the first and the second markings and when vision of the center marking is obscured by the shaft. The center marking may have a variety of shapes, for example, may be circular, elliptical, or rectangular, and may be of a different color from the first and the second markings.

In a second embodiment of the present invention, a golf club includes a shaft having a substantially tubular shape, a club head having a striking face on one side, a hosel coupling the club head to the shaft, and an appendage extending laterally from a support member, which protrudes upwardly from the club head near the toe and which provides the appendage with a direction substantially parallel to the longitudinal axis of the club head.

In a third embodiment of the present invention, a golf club includes a shaft having a substantially tubular shape, a club head having a striking face on one side, and a hosel coupling the club head to the shaft. Such hosel is composed of a lower portion extending upwardly from the club head, an upper portion coupled to the shaft, and a laterally extending portion having alignment markings thereon that connects the upper and the lower portions of the hosel. In this embodiment, a proper line of sight being is attained by a golfer addressing a ball when the shaft is seen as interposed between, and parallel to, the first and the second alignment markings on the laterally extending portion of the hosel.

In a fourth embodiment of the present invention a golf club comprises a shaft having a substantially tubular shape with a diameter and a top and bottom end, a club head having an upper surface, a lower surface, a toe end, a heel end, and a striking face disposed therebetween. The golf club further comprises a hosel coupling the upper surface to an end of the shaft, the hosel comprising a socket configured for receiving a bottom end of the shaft. The socket has at least one alignment marking thereon, and may also comprise a rear portion having at least one alignment or set-up marking thereon. A proper line of sight is attained by a golfer positioned over a ball to be struck when the shaft appears parallel to the at least one alignment or set-up marking.

This embodiment may include a plurality of alignment or set-up markings, and the markings may be substantially linear, circular, or elliptical. The markings may comprise a center marking interposed between one marking on a first edge of the rear portion and a second marking on a second edge of the rear portion. The center marking may have a substantially circular, elliptical, or rectangular shape. The hosel may also include a lower portion extending perpendicularly from the upper surface of the club head, wherein the rearwardly extending portion is interposed between the socket and the lower portion and is oriented substantially parallel to the striking face. Embodiments may comprise a shaft, a club head, a hosel and one or more alignment markings. The shaft has a substantially tubular shape with a diameter, and the club head has an upper surface, a lower surface, a toe end, a heel end and a striking face disposed therebetween. The hosel couples the upper surface of the club head to an end of the shaft. The alignment markings are at a position substantially elevated from the club head and substantially behind the shaft.

BRIEF DESCRIPTION

Exemplary embodiments of the invention will be explained in detail with reference to the following figures, in which like reference numerals refer to like parts throughout:

DETAILED DESCRIPTION

Detailed descriptions of embodiments of the invention are provided herein. It is to be understood, however, that the present invention may be embodied in various forms. Therefore, the specific details disclosed herein are not to be interpreted as limiting, but rather as a representative basis for teaching one skilled in the art how to employ the present invention in virtually any detailed system, structure, or manner.

Figure 1:
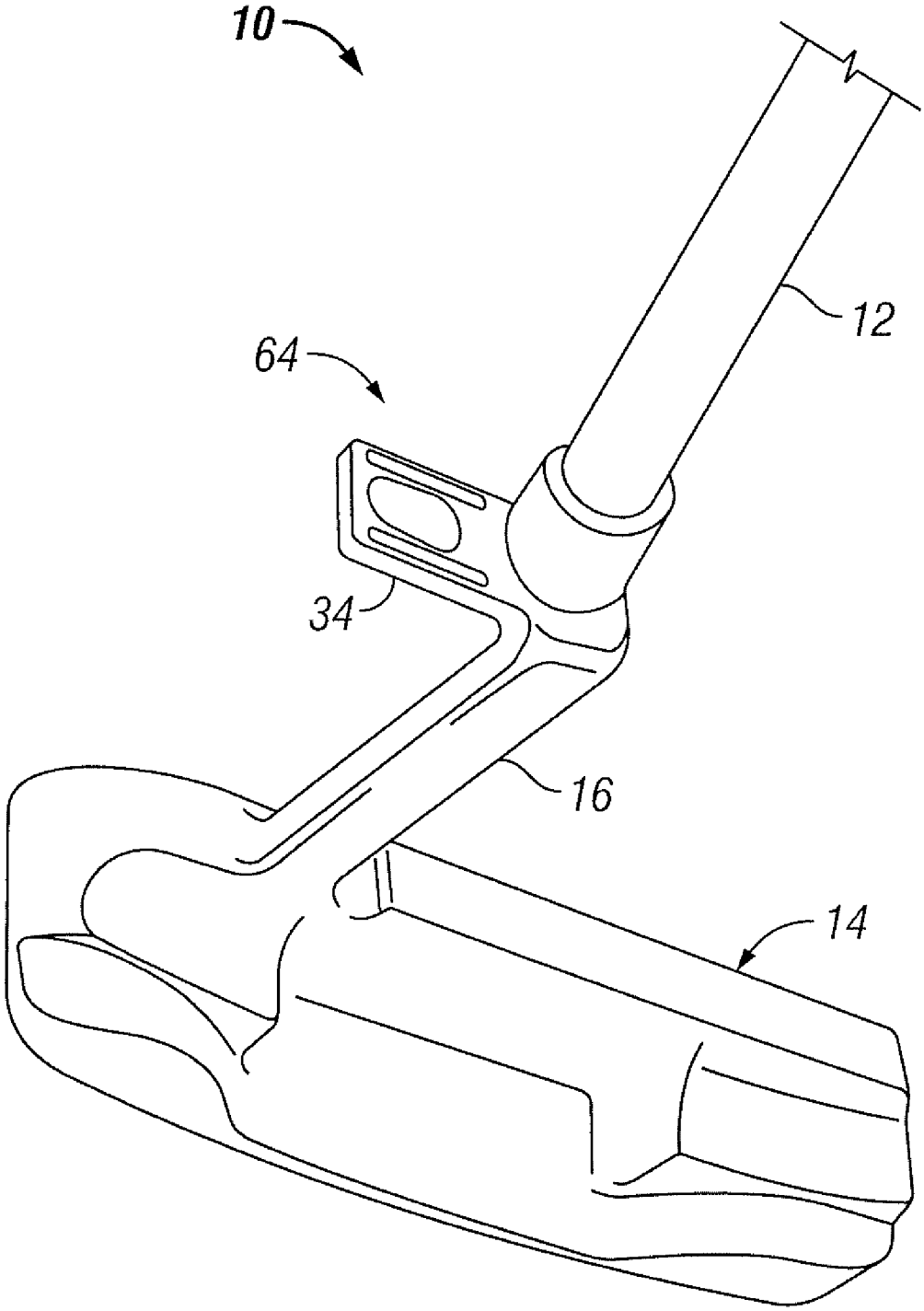
FIG. 1 is a rear perspective view of a golf club according to first embodiment of the present invention, which includes an appendage extending from the hosel and carrying alignment markings.

Referring first to FIG. 1, a first embodiment of a golf club 10 according to the invention includes a shaft 12 (only a portion of which is shown in FIG. 1), a club head 14, a hosel 16 coupling club head 14 to shaft 12, and an appendage 34 extending outwardly and rearwardly from hosel 16. While golf club 10 is illustrated in the shape of a putter, a person skilled in the art will appreciate that golf club 10 may be constructed in a variety of other shapes, such as a wood, a driver or an iron.

Shaft 12, club head 14 and hosel 16 may be produced from a variety of materials. Shaft 10, club head 14 and hosel 16 in the golf club illustrated in FIG. 1 are made of steel, but the various components of golf club 10 may also be manufactured from other metals or from a graphite composite, for example, when the ability to drive the ball to longer distances is of greater concern than accuracy.

Figure 2:
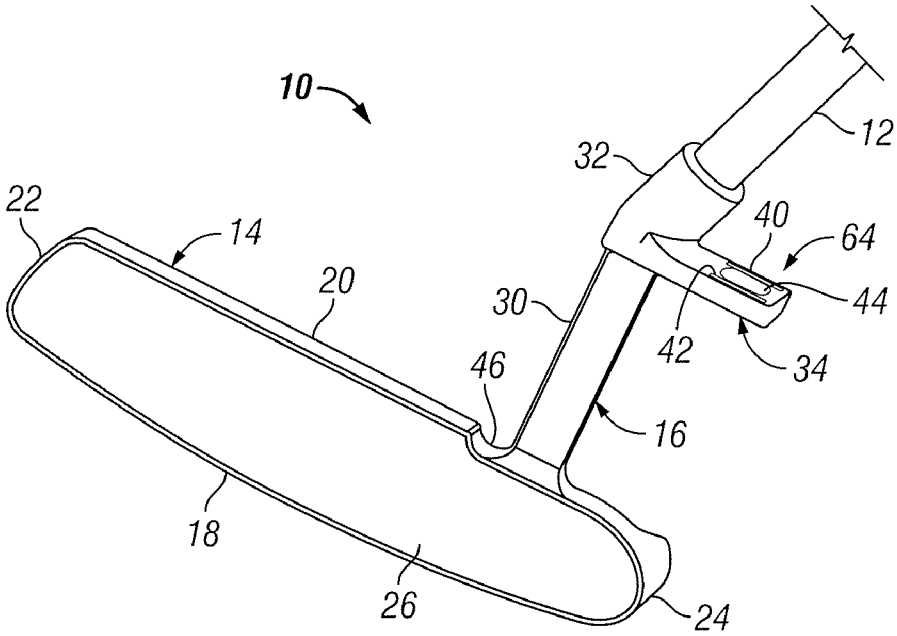
FIG. 2 is a front perspective view of the embodiment of FIG. 1.
Figure 3:
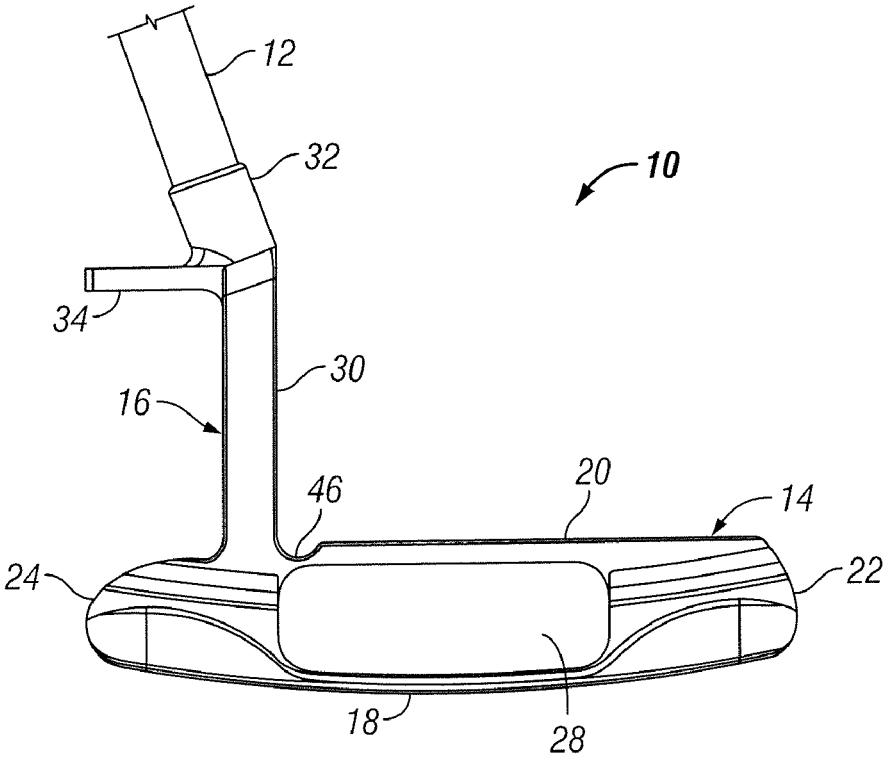
FIG. 3 is a front view of the embodiment of FIG. 1.

Referring now to FIGS. 2 and 3, club head 14 includes a lower surface 18 (often identified as the sole in the golf trade), an upper surface 20, a toe end 22, and a heel end 24, which collectively delimit a front face 26 (often identified as the striking face in the golf trade) on one side of club head 14, and a rear face 28 on the opposite side. Club head 14 may be produced as an essentially oblong piece with rounded edges or have an open upper portion, in order to lower the center of gravity of club head 14. Striking face 26 may be inclined at an angle (often identified as "loft" in the golf trade) with respect to the vertical axis of club head 14, and may be polished to a smooth finish or carry grooves or ridges in a variety of patterns that are known in the art.

Hosel 16 couples shaft 12 to club head 14 and may have a variety of shapes. In the illustrated embodiment, hosel 16 includes a lower portion 30 that extends upwardly from club head 14 in a direction substantially perpendicular to club head 14, and an upper portion 32, which is shaped like a socket adapted to receive one end of shaft 12. Socket 32 may be disposed at an angle with respect lower portion 30, in order to provide shaft 12 with a predetermined angle (sometimes identified as "lie" in the golf trade) with respect to a ground line when club head 14 is in playing position with the center of sole 18 touching the ground line.

FIGS. 1-3 illustrate a embodiments of the invention, in which appendage 34 extends outwardly and rearwardly from a position between lower portion 30 and socket 32 of hosel 16, in a direction parallel to the longitudinal axis of club head 14. Also these embodiments, hosel 16 is formed integrally with club head 14 and appendage 34, for example, by milling a single piece of metal to the desired contour or by molding a graphite composite component as a single piece. In other embodiments of the invention, appendage 34 may extend outwardly and rearwardly from shaft 12 or from club head 14.

Figure 4:
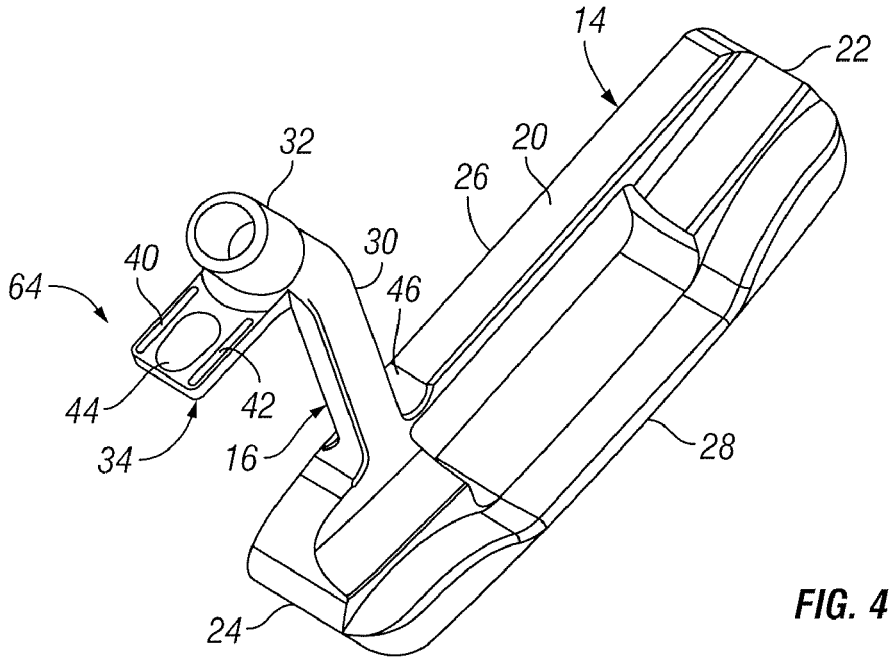
FIG. 4 is a top perspective view of the hosel, club head and appendage of the embodiment of FIG. 1.
Figure 5:
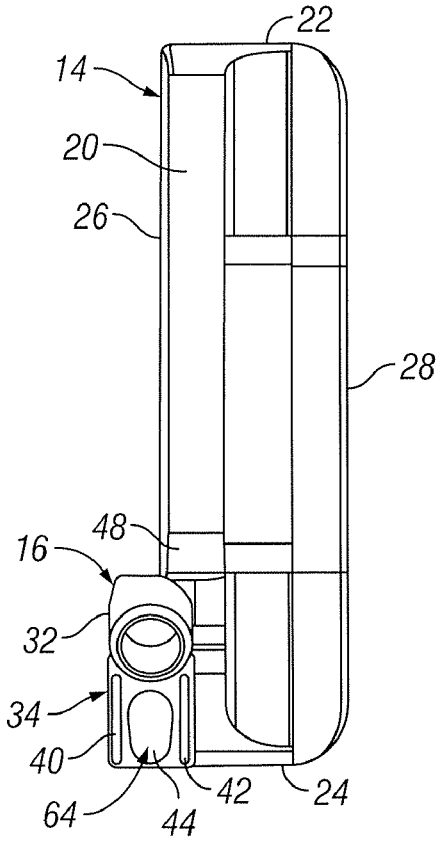
FIG. 5 is a top view of the hosel, club head and appendage of the embodiment of FIG. 1.

FIGS. 4 and 5 depict the assembly of club head 14, hosel 16 and appendage 34 of golf club 10 and show appendage 34 as carrying a plurality of parallel markings 64 on its upper face, in particular, a first marking 40 and a second marking 42. In the illustrated embodiment, first and second markings 40 and 42 are shaped as linear segments, but in different embodiments of the invention, first and second markings 40 and 42 may have a plurality of different shapes, for example, may be elliptical or circular. Further, first and second markings 40 and 42 are shown in FIGS. 4 and 5 as having the same lengths and widths, but in different embodiments of the invention, first and second markings 40 and 42 may have different lengths and widths, for example, second marking 42 may be wider than first marking 40.

First and second markings 40 and 42 are disposed in a direction essentially parallel to striking face 26 and may be spaced apart at a distance substantially equal to the diameter of shaft 12 (or to a predetermined diameter of shaft 12 if shaft 12 has a tapered shape). A benefit of having first and second markings 40 and 42 disposed as described hereinabove is that a golfer, properly positioned to strike a golf ball, will see shaft 12 along his vision line as interposed between, and parallel to, first and second markings 40 and 42, and therefore may adjust his setup to a proper position if an alignment of shaft 12 between first marking 40 and second marking 42 is not present. In other embodiments of the invention, first and second markings 40 and 42 are spaced apart at a distance less than the diameter of shaft 40, so that a golfer ready to strike a ball may confirm to that his setup is proper when first and second marking 40 and 42 are no longer visible because hidden by shaft 12.

A center marking 44 may be interposed between first marking 40 and second marking 42, so that, when a proper setup has been attained by a golfer before addressing a ball, shaft 12 may be seen as disposed between, and parallel to, first and second markings 40 and 42, while center marking 44 will become obscured by golf shaft 12, because golf shaft 12 will be overlapping center marking 44 along the vision line of the golfer.

While center marking 44 is depicted in FIGS. 4 and 5 as having a generally elliptical shape, in different embodiments of the present invention center marking 44 may have different shapes, for example, may be rectangular with the longer sides parallel to first and second markings 40 and 42, or may be circular, or may be formed by two or more dots disposed parallel to first and second markings 40 and 42. Center marking 44 and first and second markings 40 and 42 may also be of the same or of different colors, for example, center marking 44 may be red and first and second markings 40 and 42 may be white, so that a golfer can readily distinguish one type of marking from the other. Further, first and second markings 40 and 42 and optional center marking 44 may be on a flat surface of appendage 34, or may be positioned in cavities on the upper surface of appendage 34, or may be configured as slots carved into appendage 34.

Club head 14 may also include other indicia adapted to assist the golfer's posture and swing. As shown in the figures, a groove or notch 46 may be carved on upper surface 20 of club head 14 perpendicularly to striking face 26 and in a position corresponding to the center of gravity of club head 14. Alternatively, a line marking or other similar marking may be positioned on upper surface 20 perpendicularly to striking face 26 to indicate the center of gravity of club head 14 and a direction of strike against the ball.

FIG. 5 further shows that appendage 34 may extend rearwardly from the hosel for a distance that aligns the free end of appendage 34 with toe end 24. FIG. 5 also shows that appendage 34 may have a longitudinal axis (which in FIG. 5 corresponds to the longitudinal axis of center marking 44) that is disposed on or near a plane that is perpendicular to the ground and that also contains the bottom edge of striking face 26.

Figure 6:
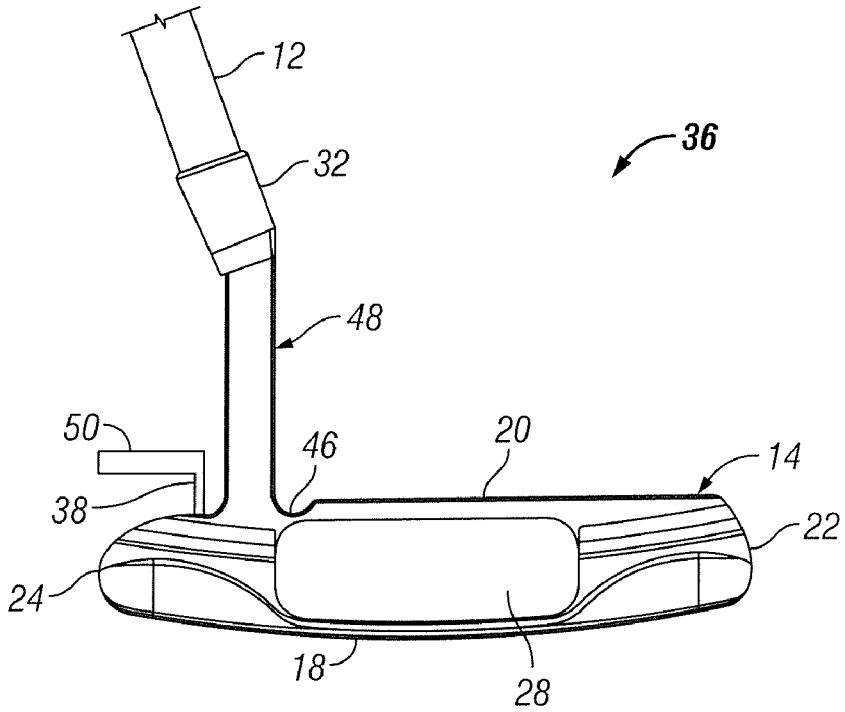
FIG. 6 is a front view of a golf club according to a second embodiment of the present invention, which includes an appendage extending from the club head and carrying alignment markings.

Referring now to FIG. 6, a second embodiment of a golf club 36 according to the present invention includes a shaft 12 (only a portion of which is shown in FIG. 6), a club head 14, a hosel 16 that connects club head 14 to shaft 12, and an appendage 50 that is coupled to club head 14. In this embodiment, a support member 38 protrudes upwardly from upper surface 20 of club head 14 and supports appendage 50, which extends laterally from support member 38. Therefore, in this embodiment appendage 50 does not extend from hosel 48, but instead from club head 14, in the proximity of toe end 24. While FIG. 4 depicts appendage 34 as extending rearwardly from support member 38 at a right angle, so to achieve a position essentially parallel to the longitudinal axis of club head 14, in variants of the present embodiment support member 38 may be disposed closer to toe end 24 and appendage 34 may extend forwardly from support member 38, or alternatively support member 38 and appendage 34 may be joined to form a T-like configuration. Support member 38 may also be disposed at different angles with respect to the longitudinal axis of club head 14 and form a "7"-like pattern with appendage 34. In other embodiment embodiments of the present invention, appendage 34 may extend from other portions of club head 14, for example, may extend rearwardly from toe end 24.

Figure 7:
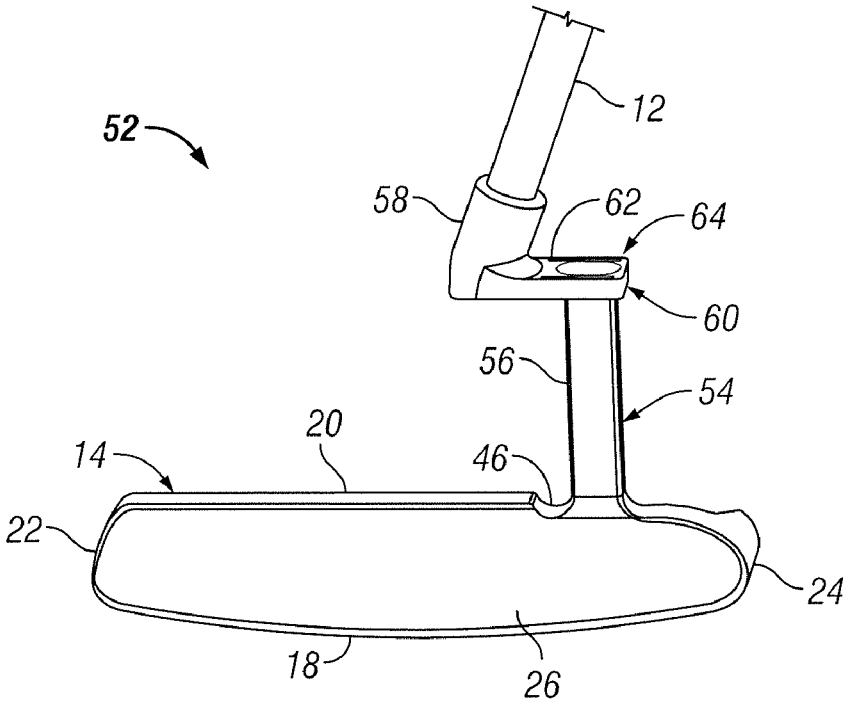
FIG. 7 is a front view of a golf club according to a third embodiment of the present invention, which includes a hosel having a laterally extending portion that carries alignment markings.

Referring now to FIG. 7, a third embodiment of a golf club 52 according to the present invention includes a shaft 12, a club head 14, and a hosel 54 coupling shaft 12 to club head 14. In this embodiment, hosel 54 is formed by a lower portion 56 that extends upwardly from club head 14, an upper portion 58 that is shaped like a socket adapted to receive shaft 12, and by a lateral extension 60 that connects lower portion 56 to upper portion 58. Lateral extension 60 has a function analogous to appendages 34 and 50 described hereinabove, that is, lateral extension 60 carries indicia or markings 64 on its upper face 62 that assist a golfer in finding a proper posture before addressing a ball. Markings 64 are shown in FIG. 7 as including two parallel lines and a center marking, but a person skilled in the art will appreciate that these indicia 64 may also be configured with different shapes and be of the types, numbers, shapes, dimensions, and print impressions that have been described for the previous embodiments. Generally speaking, the indicia or markings 64 are situated at a position on or above the club head 14, on or behind the hosel 54 and/or behind the shaft 12. That way, in operation one or more of the alignment markings 64 are obscured by or, if visible, aligned with the shafts to assist the golfer with pre-stroke positioning, alignment and/or proper arc stroke.

A method of use of a golf club according to the present invention will be described hereinbelow, which, for the sake of brevity, will relate to the use of golf club 10. It should be understood that similar methods of use are also applicable to other types of golf clubs such as irons or woods.

While preparing to address a ball, a golfer will initially position his body by standing over the ball and by putting club head 14 on the ground just behind the ball. The golfer should stand far enough away so to reach the ball with putter 10 comfortably and without a feeling of stretching out, while club head 10 should be square with the ball.

The golfer will then adjust the position of club 10 by properly aligning shaft 12 with first and second markings 40 and 42. When first and second markings 40 and 42 are spaced apart at a distance substantially equal to the diameter of shaft 12 and when optional center marking 44 is also disposed between first and second center markings 40 and 42, the golfer will align shaft 12 between first and second markings 40 and 42 such that shaft 12 can be seen as parallel to first and second markings 40 and 42. At the same time, the golfer will position shaft 12 to ensure that center marking 44 is not visible, that is, that vision of center marking 44 has become obscured by shaft 12. Groove 46 will also be aligned with the ball, in order to position the center of gravity of club head 12 near the ball. This arrangement provides the golfer with a club position that ensures that club head 14 is perpendicular to the ball and to the ground, so that the ball can be addressed at the desired angle. When proper posture of the golfer is achieved, the golfer becomes ready to swing club 10 and strike the ball. By achieving a proper posture before each swing of the club, head and body misalignment of the golfer are reduced, generating a more square and consistent golf stroke and reducing player fatigue. The body of the golfer will also be induced to develop a more natural swing arc, improving the quality of the stroke and the enjoyment of the game.

Figure 8:
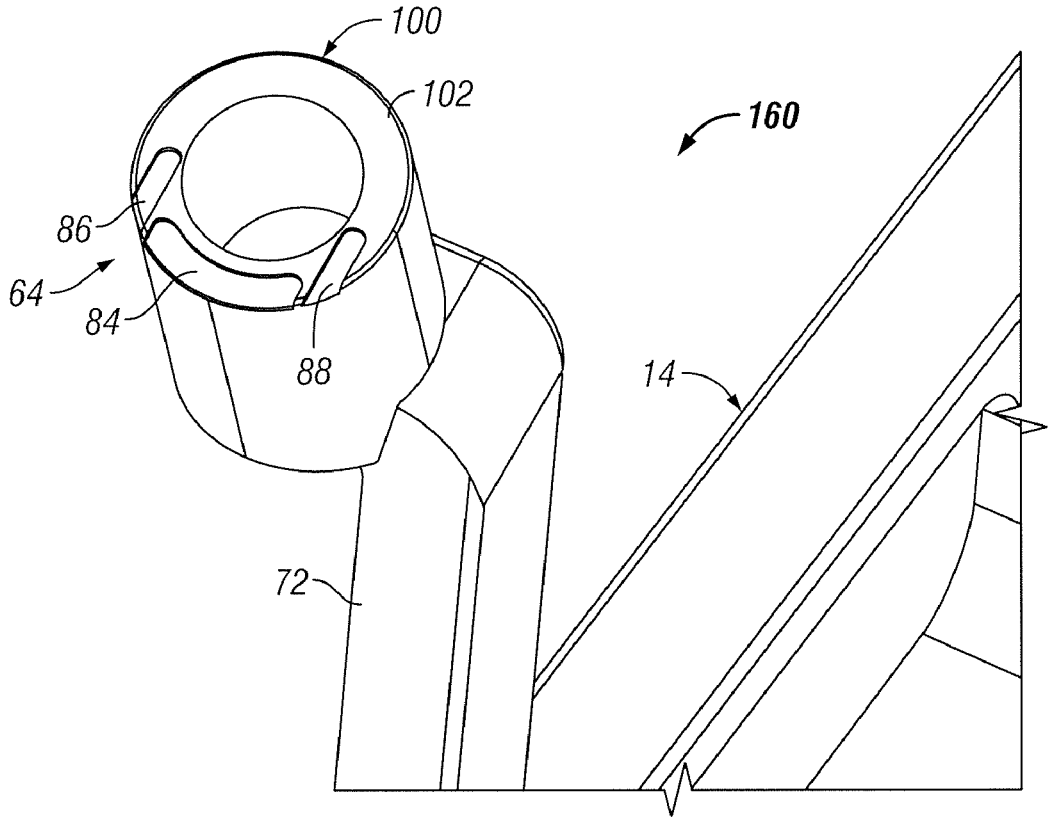
FIG. 8 is a perspective view of a golf club according to a fourth embodiment of the present invention, which includes a socket having a rear portion that carries alignment markings.
Figure 9:
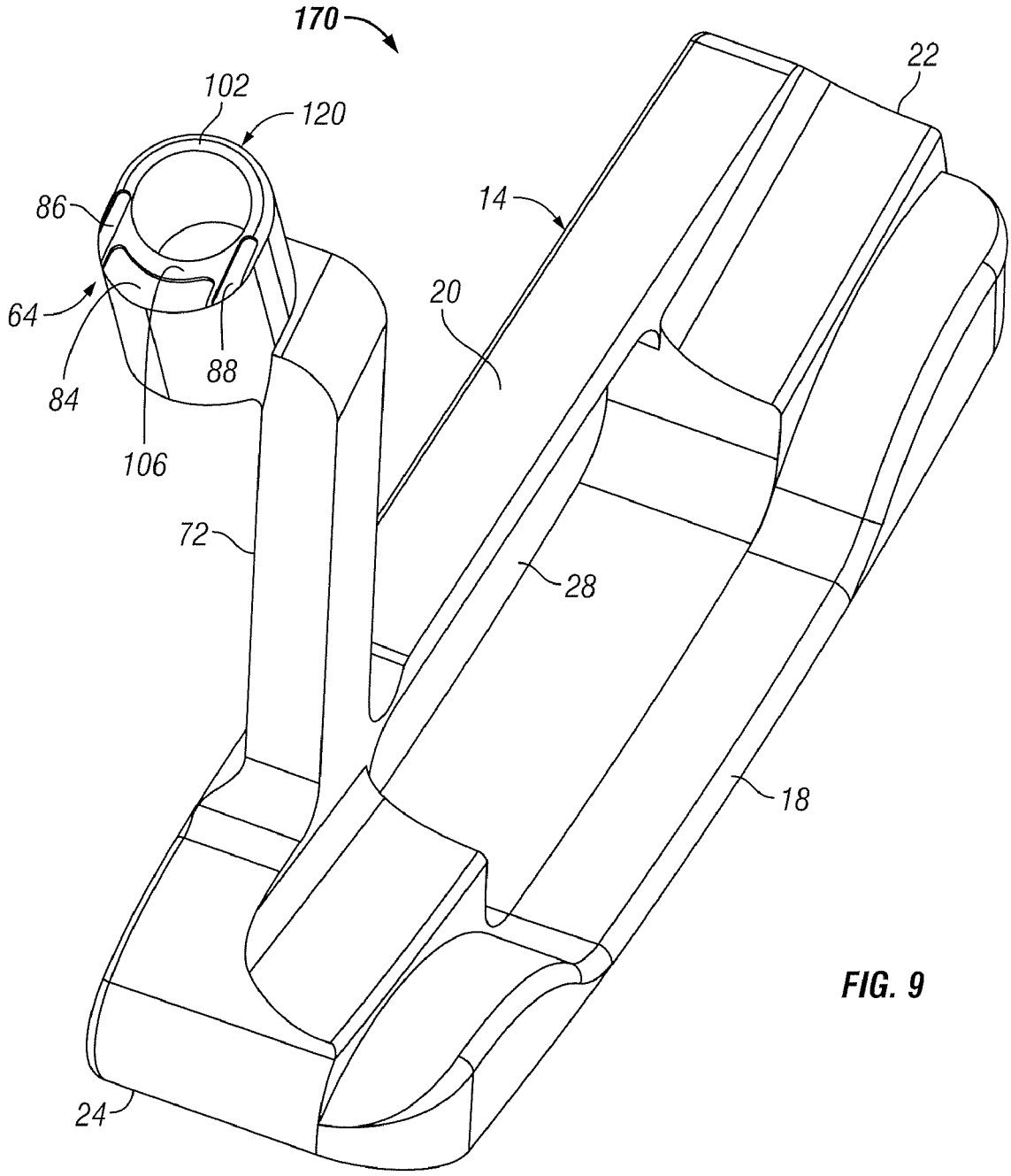
FIG. 9 is a perspective view of a golf club according to an embodiment of the invention, which includes a socket having a rear portion that carries alignment markings.
Figure 10:
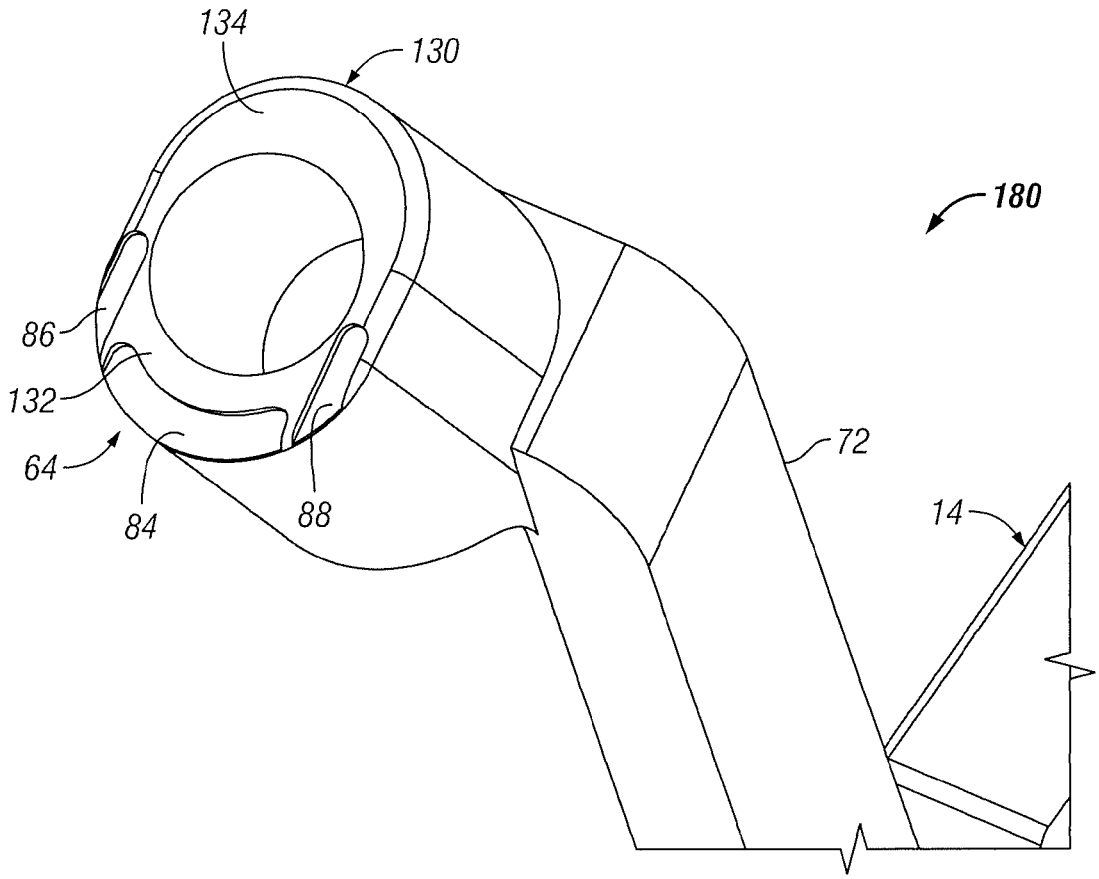
FIG. 10 is a perspective view of a golf club according to an embodiment of the invention, which includes a socket having a rear portion that carries alignment markings.
Figure 11:
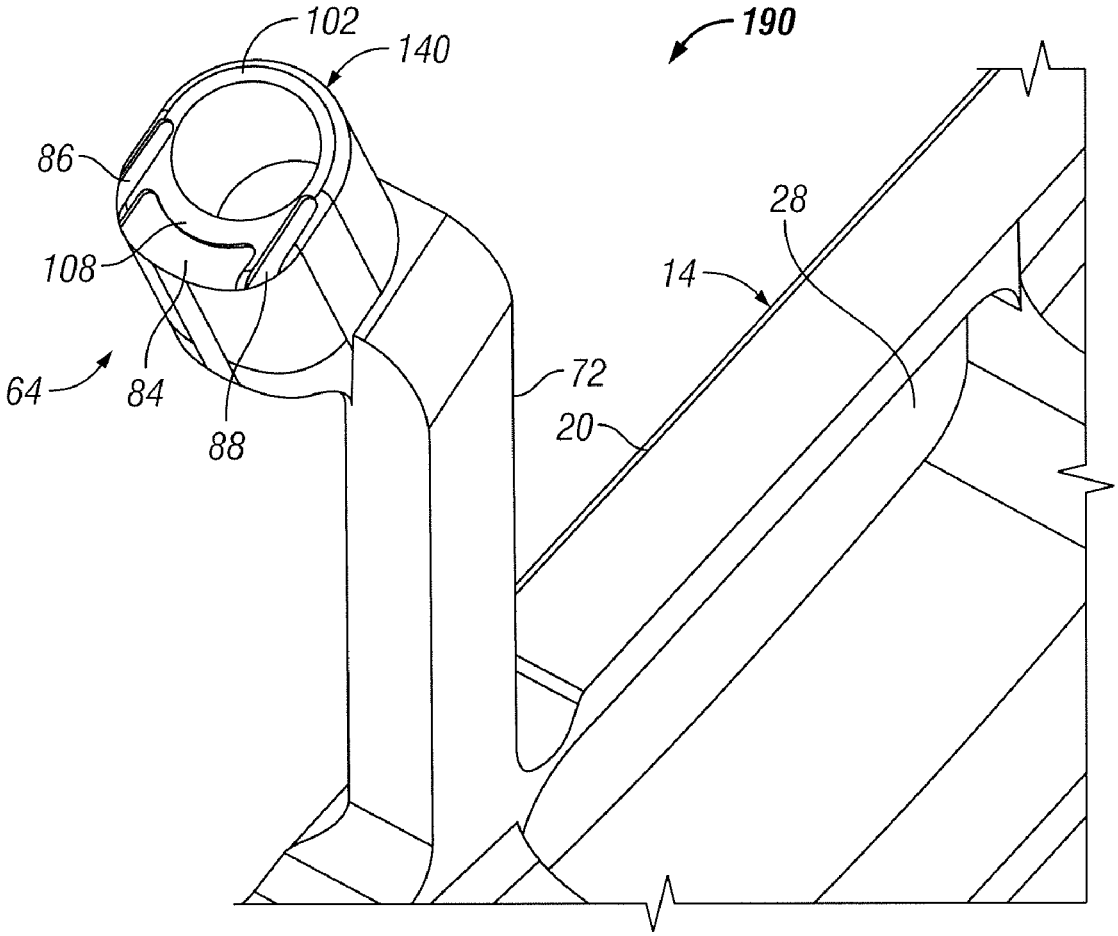
FIG. 11 is a perspective view of a golf club according to an embodiment of the invention, which includes a socket having a rear portion that carries alignment markings.
Figure 12:
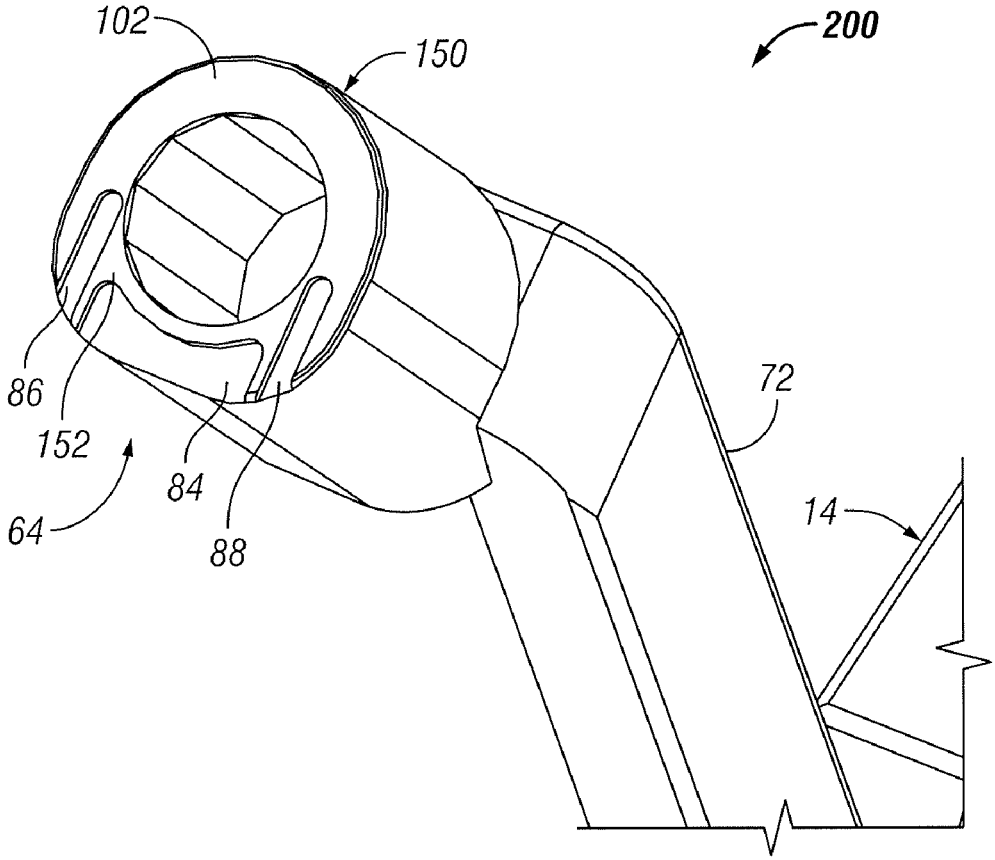
FIG. 12 is a perspective view of a golf club according to an embodiment of the invention, which includes a socket having a rear portion that carries alignment markings.
Figure 13:
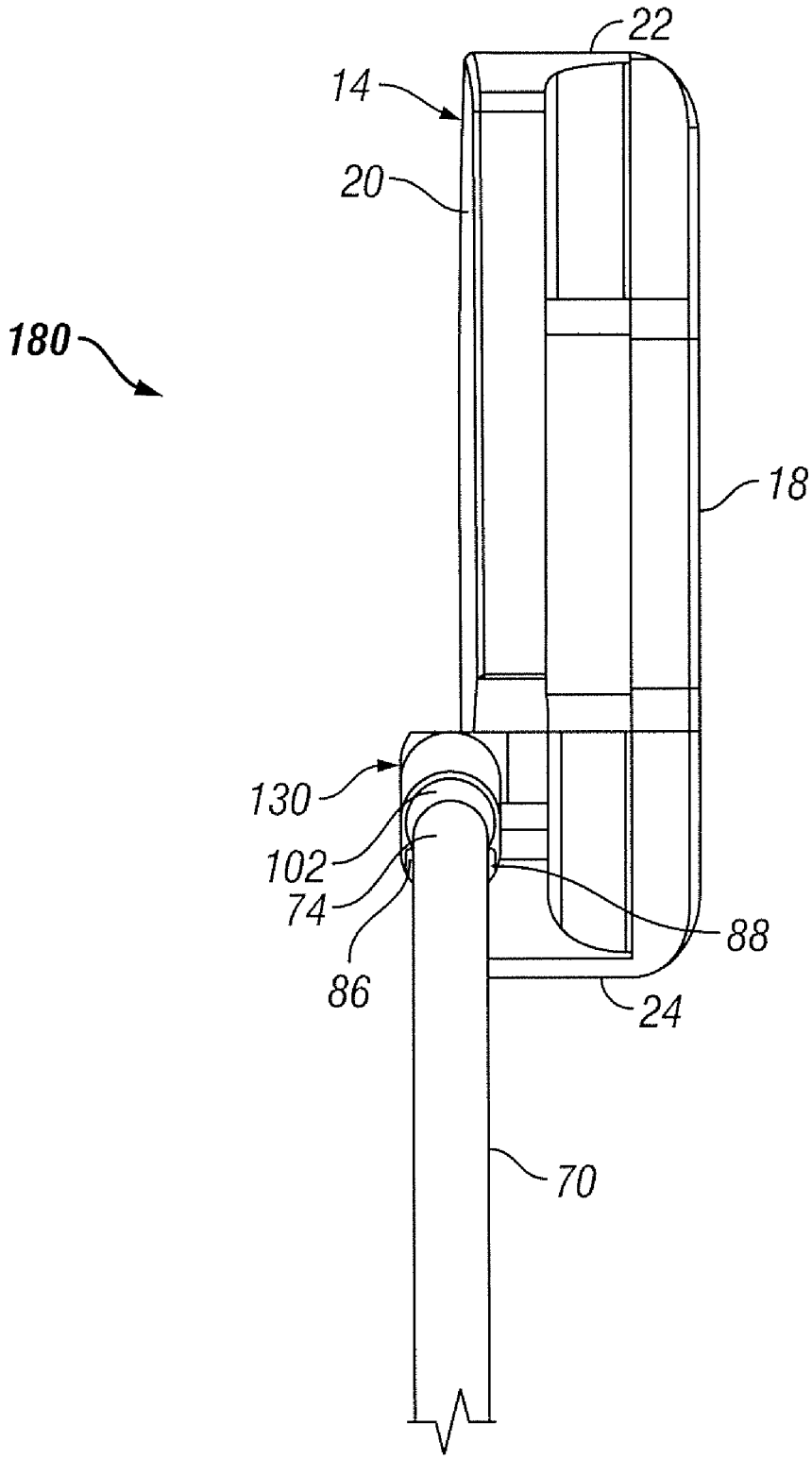
FIG. 13 is a top perspective view of the golf club of the embodiment of FIG. 10.

Turning to FIG. 8, a fourth embodiment of a golf club 160 in accordance with the present invention includes club head 14, shaft 70 (a portion of which is shown in FIG. 13) having a top end (not shown) and a bottom end 74, and a hosel 72 that serves to connect club head 14 to shaft 70. The club head 14 of embodiments shown in FIGS. 8-13 includes a lower surface 18 (often identified as the sole in the golf trade), an upper surface 20, a toe end 22, and a heel end 24, which collectively delimit a front face 26 (often identified as the striking face in the golf trade) on one side of club head 14, and a rear face 28 on the opposite side. Hosel 72 includes a socket 100 for receiving bottom end 74 of shaft 70. Socket 100 is integrally formed with hosel 72, in this case at a location such that rim 102 is substantially aligned with hosel 72. Thus, shaft 70 is above and substantially aligned with hosel 72. Socket 100 is substantially round in shape. Other embodiments include: a golf club 170 comprising a substantially oval shaped socket 120 having a slightly extended rear surface 106 with alignment markings 64, as shown in FIG. 9; a golf club 180 comprising a substantially oval socket 130 having slightly extended forward and rear portions 134, 132 with alignment markings 64 on the rear surface, as shown in FIG. 10; a golf club 190 comprising a substantially oval socket 140 having a partially straight extended rear portion 108 with alignment markings 64 on the rear surface, as shown in FIG. 11; and a golf club 200 comprising a substantially circular socket 150 having an interior with graduated angles and a partially straight rear surface 152 with alignment markings 64 on the rear surface, as shown in FIG. 12.

FIGS. 14-19 illustrate embodiments of a golf club 66 having alignment markings on a rear portion of the socket. In these embodiments, alignment markings 64 are on the surface of socket 102 at the back end, or rear portion 78 of the surface. Rear portion 78 of socket 76 has at least one alignment marking 64 on the upward facing surface 80 of the rear portion 78. Thus, this embodiment does not have a separate appendage extending from the hosel or from the club head. Socket 76 is integrally formed with hosel 72, in this case at a location such that rim 82 is substantially aligned with hosel 72. Thus, shaft 70 is above and substantially aligned with hosel 72. The markings 64 may comprise a center marking 84 interposed between one marking 86 and a second marking 88. The center marking 84 shown here is elliptical, but it may have a substantially circular, rectangular, or other shapes. Markings 84, 86 and 88 are at a location slightly rearward relative to hosel 72 due to the general location of socket 76, as described above.

Rear portion 78 may extend from hosel 72 parallel to the angle of socket 76 and flush with socket rim 82. As such, rear portion 78 is slightly angled relative to the longitudinal axis of club head 14. Such angle corresponds to the desired angle of shaft 70 relative to the longitudinal axis of club head 68. This is due to the connecting function of hosel 72, which serves to connect shaft 70 to club head 68. However, socket 76 could be designed such that rear portion 78 has a different angle than socket rim 82, and a number of varying angles could be employed. Rear portion 78 may extend rearwardly from hosel 72 for varying lengths depending on the type of golf club desired.

Figure 14:
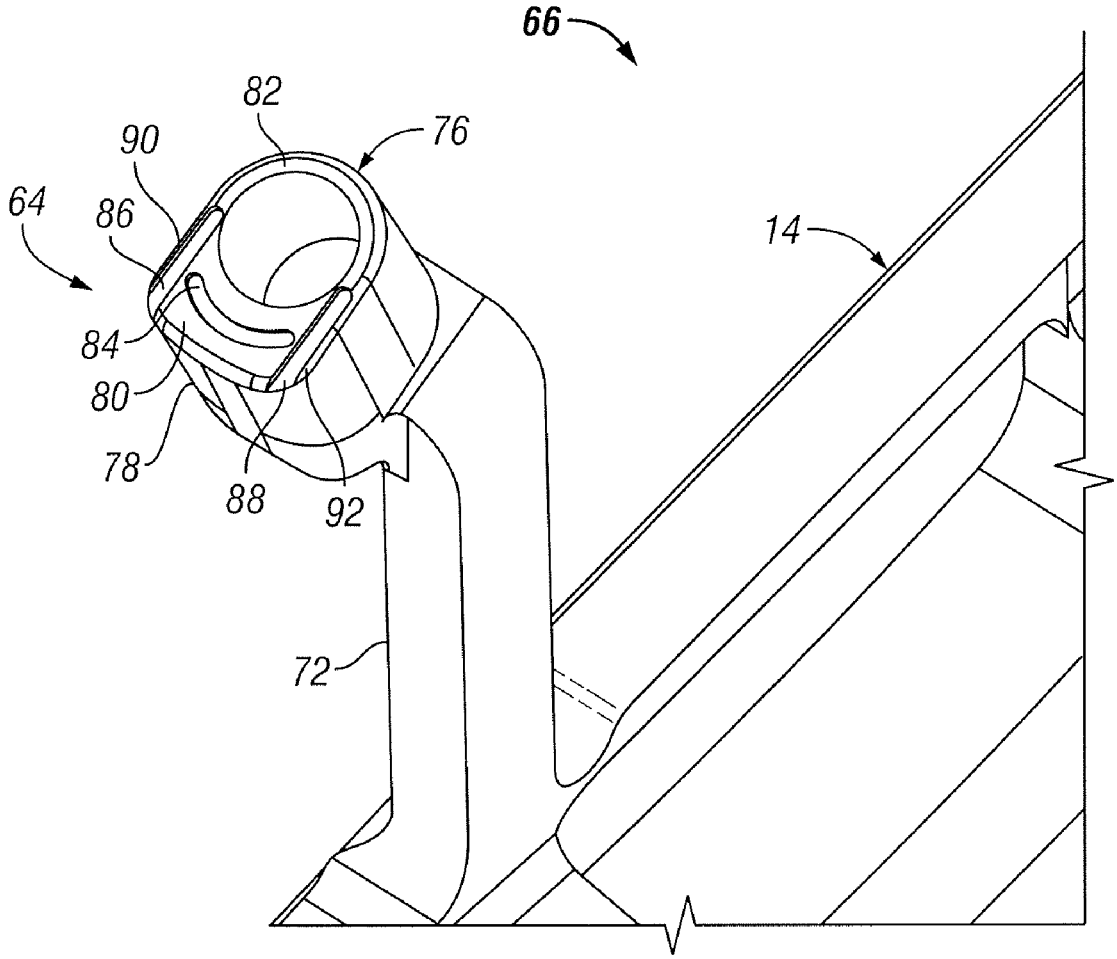
FIG. 14 is a perspective view of a golf club according to an embodiment of the invention, which includes a socket having a rear portion that carries alignment markings.
Figure 15:
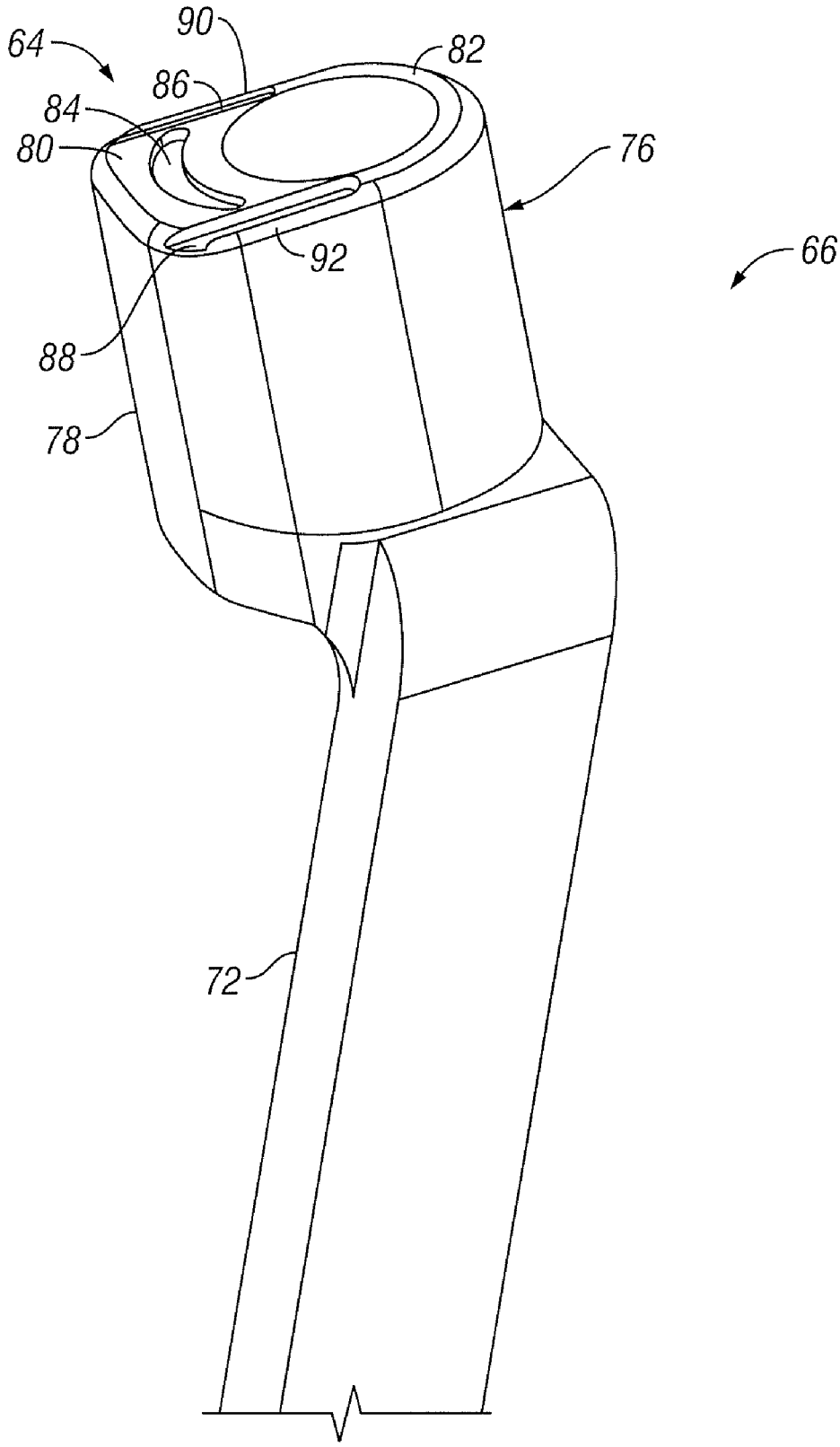
FIG. 15 is a side perspective view of the golf club of the embodiment of FIG. 14.
Figure 16:
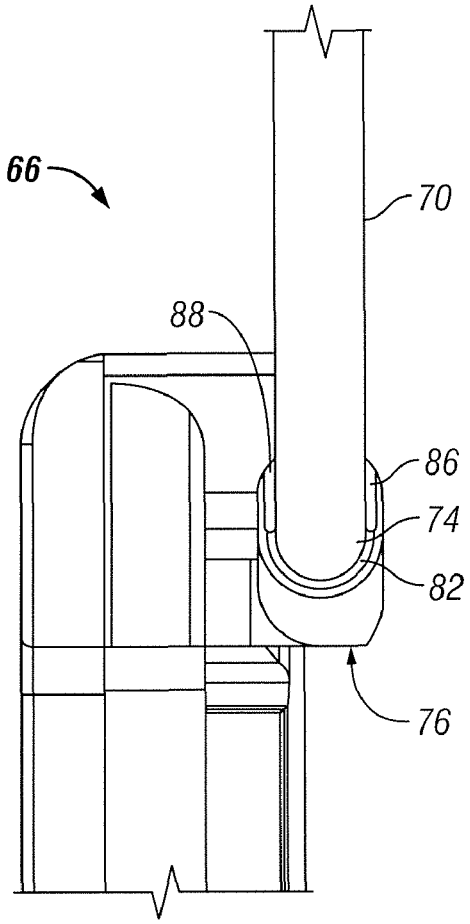
FIG. 16 is a top perspective view of the golf club of the embodiment of FIG. 14.
Figure 17:
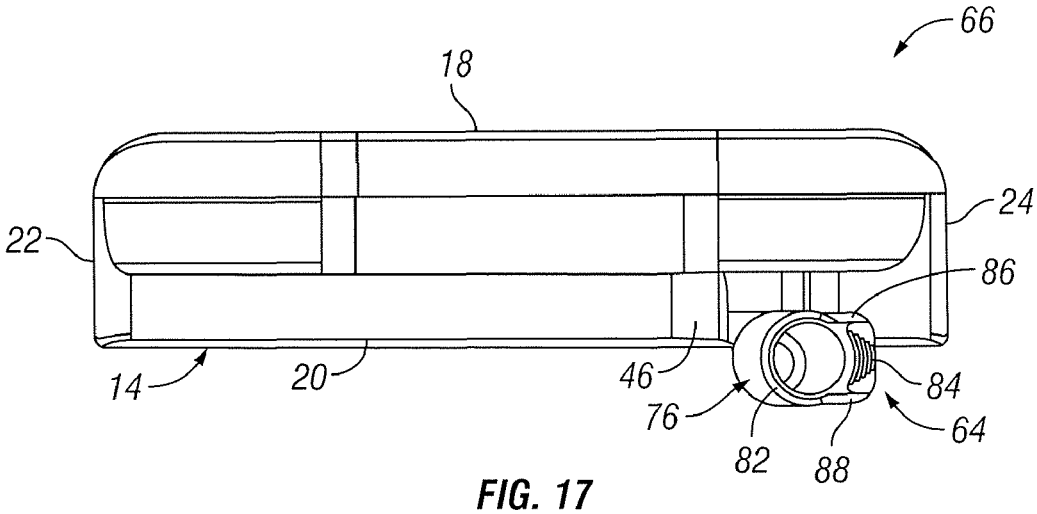
FIG. 17 is a top view of the golf club of the embodiment of FIG. 14 having a rear portion that carries a variation of alignment markings.
Figure 18:
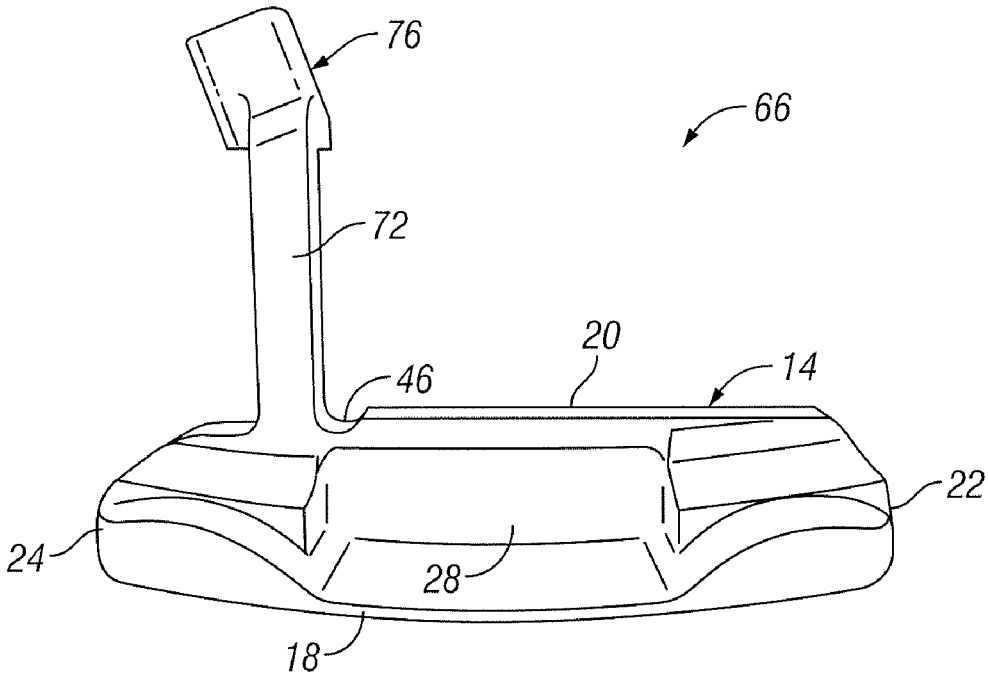
FIG. 18 is a back view of the golf club of the embodiment of FIG. 17.
Figure 19:
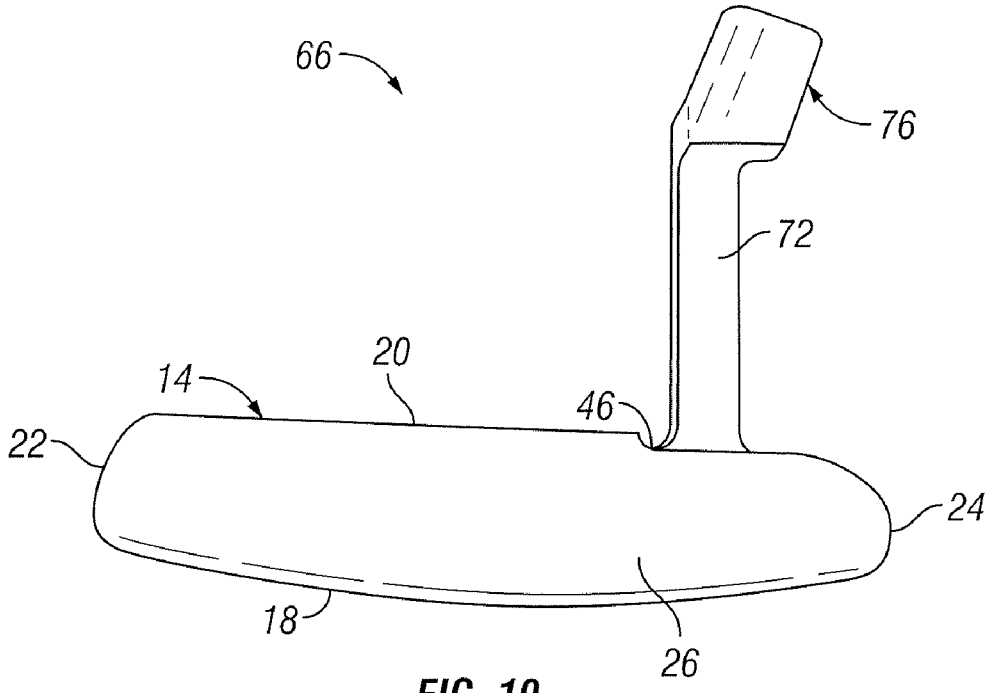
FIG. 19 is a front view of the golf club of the embodiment of FIG. 17.

Rear portion 78 may include a plurality of alignment or set-up markings, and the markings may be substantially linear, circular, or elliptical in shape. As best seen in FIG. 14, the markings may comprise a center marking 84 interposed between one marking 86 on a first edge 90 of the rear portion and a second marking 88 on a second edge 92 of rear portion 78. The center marking 84 shown here is elliptical, but it may have a substantially circular, rectangular, or other shapes.

Markings 84, 86 and 88 are at a location slightly rearward relative to hosel 72 due to the general location of socket 76, as described above. In a variation shown in FIG. 17, alignment markings 64 comprise center markings 84 arranged in concentric curved lines.

Figure 20:
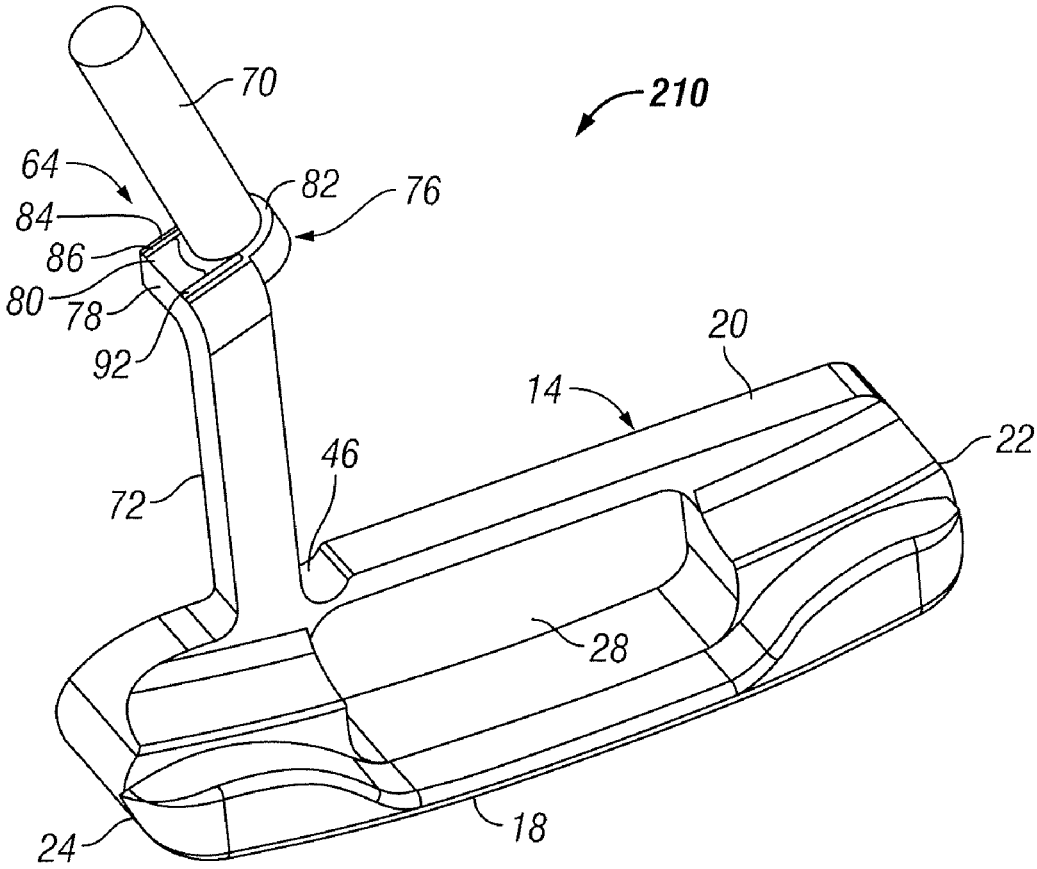
FIG. 20 is a perspective view of another embodiment of the invention, which includes a socket having a rear portion that carries alignment markings.

Another embodiment is shown in FIG. 20. In this embodiment, the rear portion 78 of socket 76 is integrally formed with hosel 72, in this case at a location such that rear portion 78 is substantially aligned with and above hosel 72. Socket rim 82 is located slightly forward of hosel 72. Thus, shaft 70 is slightly forward of and above hosel 72, and markings 84, 86 and 88 are generally aligned with hosel 72.

While the invention has been described in connection with the above described embodiments, it is not intended to limit the scope of the invention to the particular forms set forth, but on the contrary, it is intended to cover such alternatives, modifications, and equivalents as may be included within the scope of the invention. Further, the scope of the present invention fully encompasses other embodiments that may become obvious to those skilled in the art and the scope of the present invention is limited only by the appended claims.

What is claimed is:

1. A golf club comprising:

a club head having an upper surface;

a mounting member extending from the club head;

a shaft extending from and mounted to the club head; and one or more alignment marking positioned on and protruding from the mounting member, the one or more alignment marking substantially elevated from the club head and spatially separated from the upper surface and at least a portion of the club shaft extending above the alignment marking wherein in use and viewed from above, a portion of the alignment marking is adjacent to or obscured by the shaft when in a desired alignment, wherein the one or more alignment marking is positioned on an appendage extending outwardly from the mounting member and the appendage extends rearwardly from the mounting member, wherein the mounting member comprises a lower portion extending upwardly from the upper surface of the club head and a mounting socket configured for receiving an end of the shaft, and wherein the appendage is interposed between the socket and the lower portion and is oriented substantially parallel to the lower surface.

2. The golf club of claim 1, wherein the mounting member is formed integrally with the club head and comprises a hosel.

3. The golf club of claim 1, wherein the mounting member extends upwardly from the upper surface of the club head in the proximity of a heel end of the club head, and wherein the appendage extends from the support member in a direction substantially parallel to a longitudinal axis of the club head.

4. A golf club comprising:

a club head having an upper surface and a toe end;

a hosel extending from the club head, the hosel including a mounting socket;

a shaft extending from and mounted to the club head via the mounting socket of the hosel;

wherein the golf club includes one or more alignment markings positioned on one or more of an upper surface of the hosel adjacent the shaft and mounting socket, an appendage extending rearwardly from the hosel, or an appendage extending from the upper surface of the club head between the hosel and the toe end of the club head, the alignment markings being positioned above and spatially separated from the upper surface, and at least a portion of the club shaft extending above the one or more alignment markings wherein in use and viewed from above, a portion of the one or more alignment markings is adjacent to or obscured by the shaft when in a desired alignment.

5. The golf club of claim 4, wherein the appendage extends outwardly from the shaft or the mounting member.

6. The golf club of claim 4 further comprising a lower surface of the club head wherein the one or more alignment markings are spatially separated from the lower surface and are substantially parallel to the lower surface.

7. The golf club of claim 6, wherein the one or more alignment markings include substantially linear, circular, or elliptical segments of equal or different widths.

8. The golf club of claim 6, wherein the one or more alignment markings include at least two markings that are spaced apart at a distance substantially equal to the diameter of the shaft.

9. The golf club of claim 6, wherein the one or more alignment markings include substantially linear segments, and wherein a center marking is interposed between a first and second alignment markings, whereby the proper line of sight is further attained when vision of the center marking is obscured by the shaft.

10. The golf club of claim 9, wherein the center marking has a substantially circular, elliptical, or rectangular shape.

11. The golf club of claim 4 wherein:

the mounting member includes a hosel protruding from the upper surface, the alignment marking mounted on or substantially integral with the hosel and extending from the hosel at a location that is spatially separated from and above the upper surface of the club head; and the shaft mounted to the club head via the hosel and extends from the hosel.

12. The golf club of claim 11 wherein:

the alignment marking extends from the hosel in a different direction from the direction in which the shaft extends from the hosel.

13. The golf club of claim 4 wherein the hosel includes a mounting portion, the club head mounted to the mounting portion of the hosel, and the alignment markings positioned on an upper surface of the hosel.

14. A golf club comprising:

a club head having an upper surface;

a mounting member extending from the club head;

a shaft extending from and mounted to the club head; and one or more alignment marking positioned on and protruding from the mounting member, the one or more alignment marking substantially elevated from the club head and spatially separated from the upper surface and at least a portion of the club shaft extending above the alignment marking wherein in use and viewed from above, a portion of the alignment marking is adjacent to or obscured by the shaft when in a desired alignment, wherein an upper portion of the mounting member defines a mounting socket receiving a bottom end of the shaft, mounting member including a generally upper surface around the socket the one or more alignment marking positioned on the upper surface of the mounting member.

15. The golf club of claim 14, wherein the upper surface of the mounting member further comprises a rear portion, the one or more marking located on the rear portion.

16. The golf club of claim 15, wherein the mounting member further comprises a lower portion extending substantially perpendicular from the upper surface of the club head, wherein the rear portion is interposed between the socket and the lower portion and is oriented substantially parallel to a lower surface of the club head.

17. The golf club of claim 16, wherein the one or more alignment markings comprise a center marking interposed between one marking on a first edge of the rear portion and a second marking on a second edge of the rear portion.

18. The golf club of claim 14, wherein the club head is formed integrally with the mounting member.

* * * * *